US008839883B2

(12) United States Patent
Hay

(10) Patent No.: US 8,839,883 B2
(45) Date of Patent: Sep. 23, 2014

(54) PISTON TRACTOR SYSTEM FOR USE IN SUBTERRANEAN WELLS

(71) Applicant: Halliburton Energy Services, Inc., Houston, TX (US)

(72) Inventor: Richard T. Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/753,959

(22) Filed: Jan. 30, 2013

(65) Prior Publication Data

US 2013/0206396 A1 Aug. 15, 2013

(30) Foreign Application Priority Data

Feb. 13, 2012 (WO) ..... PCT/US2012/024914

(51) Int. Cl.

| | |
|---|---|
| ***E21B 4/00*** | (2006.01) |
| ***E21B 23/00*** | (2006.01) |
| ***E21B 47/09*** | (2012.01) |
| ***E21B 23/04*** | (2006.01) |

(52) U.S. Cl.

CPC ..... *E21B 23/04* (2013.01); *E21B 47/09* (2013.01)

USPC ..... 175/98; 175/99; 175/95; 166/381; 166/206

(58) Field of Classification Search

USPC ..... 166/381, 383, 209, 191, 243, 248, 153, 166/65.1, 154, 113, 53, 250.01, 206; 175/51, 95, 99, 92, 98, 108

See application file for complete search history.

(56) References Cited

U.S. PATENT DOCUMENTS 4,314,615 A 2/1982 Sodder, Jr. et al.
4,729,429 A * 3/1988 Wittrisch ..... 166/66.7

(Continued)

FOREIGN PATENT DOCUMENTS

WO 2008024925 A1 2/2008

OTHER PUBLICATIONS

Search Report issued Aug. 30, 2012 for International Application No. PCT/US12/24914, 5 pages.

(Continued)

*Primary Examiner* — Kenneth L Thompson
*Assistant Examiner* — Michael Wills, III
(74) *Attorney, Agent, or Firm* — Smith IP Services, P.C.

(57) ABSTRACT

A piston tractor system can include at least two piston assemblies which sealingly engage a wellbore, and a pump which transfers fluid between an annulus isolated between the piston assemblies, and another annulus. A method of operating a piston tractor system can include sealingly engaging at least two piston assemblies with a wellbore, grippingly engaging one piston assembly with the wellbore, and then pumping a fluid from an annulus formed between the piston assemblies, while the other piston assembly is secured to a tubular string, thereby biasing the tubular string to displace through the first piston assembly. A method of advancing a tubular string through a wellbore can include sealingly engaging piston assemblies with the wellbore, each of the piston assemblies including a gripping device which selectively grips the wellbore, and one piston assembly including another gripping device which selectively grips the tubular string.

75 Claims, 9 Drawing Sheets

(56) References Cited

U.S. PATENT DOCUMENTS

| | | | | |
|---|---|---|---|---|
| 6,062,315 | A | 5/2000 | Reinhardt | |
| 6,089,323 | A * | 7/2000 | Newman et al. | 166/381 |
| 6,142,245 | A | 11/2000 | Best | |
| 6,230,813 | B1 * | 5/2001 | Moore et al. | 166/381 |
| 6,241,031 | B1 * | 6/2001 | Beaufort et al. | 175/99 |
| 6,273,189 | B1 | 8/2001 | Gissler et al. | |
| 6,286,592 | B1 | 9/2001 | Moore et al. | |
| 6,315,498 | B1 * | 11/2001 | Baugh et al. | 405/184 |
| 6,427,786 | B2 | 8/2002 | Beaufort et al. | |
| 6,464,003 | B2 | 10/2002 | Bloom et al. | |
| 6,745,854 | B2 | 6/2004 | Bloom et al. | |
| 6,857,486 | B2 | 2/2005 | Chitwood et al. | |
| 6,863,137 | B2 | 3/2005 | Terry et al. | |
| 7,172,026 | B2 * | 2/2007 | Misselbrook | 166/381 |
| 7,273,108 | B2 * | 9/2007 | Misselbrook | 166/381 |
| 7,273,109 | B2 * | 9/2007 | Moore et al. | 166/381 |
| 7,743,849 | B2 * | 6/2010 | Kotsonis et al. | 175/51 |
| 7,836,950 | B2 * | 11/2010 | Vail et al. | 166/250.15 |
| 8,353,354 | B2 * | 1/2013 | Hall et al. | 166/381 |
| 8,602,115 | B2 * | 12/2013 | Aguirre et al. | 166/382 |
| 2004/0020691 | A1 * | 2/2004 | Krueger | 175/27 |
| 2004/0072437 | A1 | 4/2004 | Lizuka et al. | |
| 2005/0217861 | A1 * | 10/2005 | Misselbrook | 166/373 |
| 2008/0066963 | A1 * | 3/2008 | Sheiretov et al. | 175/51 |
| 2008/0202769 | A1 | 8/2008 | Dupree et al. | |
| 2009/0062725 | A1 | 3/2009 | Goebel | |
| 2009/0065536 | A1 | 3/2009 | Moon et al. | |
| 2009/0159269 | A1 | 6/2009 | Sheiretov et al. | |
| 2009/0218105 | A1 * | 9/2009 | Hill et al. | 166/383 |
| 2009/0277687 | A1 * | 11/2009 | Lee | 175/57 |
| 2011/0127046 | A1 | 6/2011 | Aguirre et al. | |

OTHER PUBLICATIONS

Written Opinion issued Aug. 30, 2012 for International Application No. PCT/US12/24914, 3 pages.

International Search Report with Written Opinion issued Aug. 30, 2012 for PCT patent Application No. PCT/US12/024914, 8 pages.

Schlumberger; "MaxTRAC Downhole Well Tractor System", online overview, dated 2013, 2 pages.

Rigzone; "How Do Well Tractors Work?", online article via rogzone.com, dated Jul. 29, 2013, 2 pages.

Schlumberger; "TuffTRAC and TuffTRAC Mono Cased Hole Services Tractors", online overview, dated 2013, 2 pages.

John Kennedy: "Anaconda Drilling System Nears Commercial Rollout", Drilling Contractor magazine, dayed Jul./ Aug. 2000, 2 pages.

* cited by examiner

PISTON TRACTOR SYSTEM FOR USE IN SUBTERRANEAN WELLS

CROSS-REFERENCE TO RELATED APPLICATION

This application claims the benefit under 35 USC §119 of the filing date of International Application Serial No. PCT/US12/24914 filed 13 Feb. 2012. The entire disclosure of this prior application is incorporated herein by this reference.

BACKGROUND

This disclosure relates generally to equipment utilized and operations performed in conjunction with a subterranean well and, in one example described below, more particularly provides a piston tractor system.

In some circumstances (such as, ultra-extended-reach wells having very long horizontal sections, etc.) it can be beneficial to use a tractor to advance a tubular string through a wellbore. For example, a weight of the tubular string could be insufficient to advance the tubular string through the wellbore.

It will, therefore, be readily appreciated that improvements are continually needed in the art of constructing and operating tractors for use in subterranean wells. Such improvements could be useful in a well, whether or not the well is an ultra-extended-reach well, and/or whether or not a weight of a tubular string is insufficient to advance the tubular string through a wellbore.

DETAILED DESCRIPTION

Figure 1:
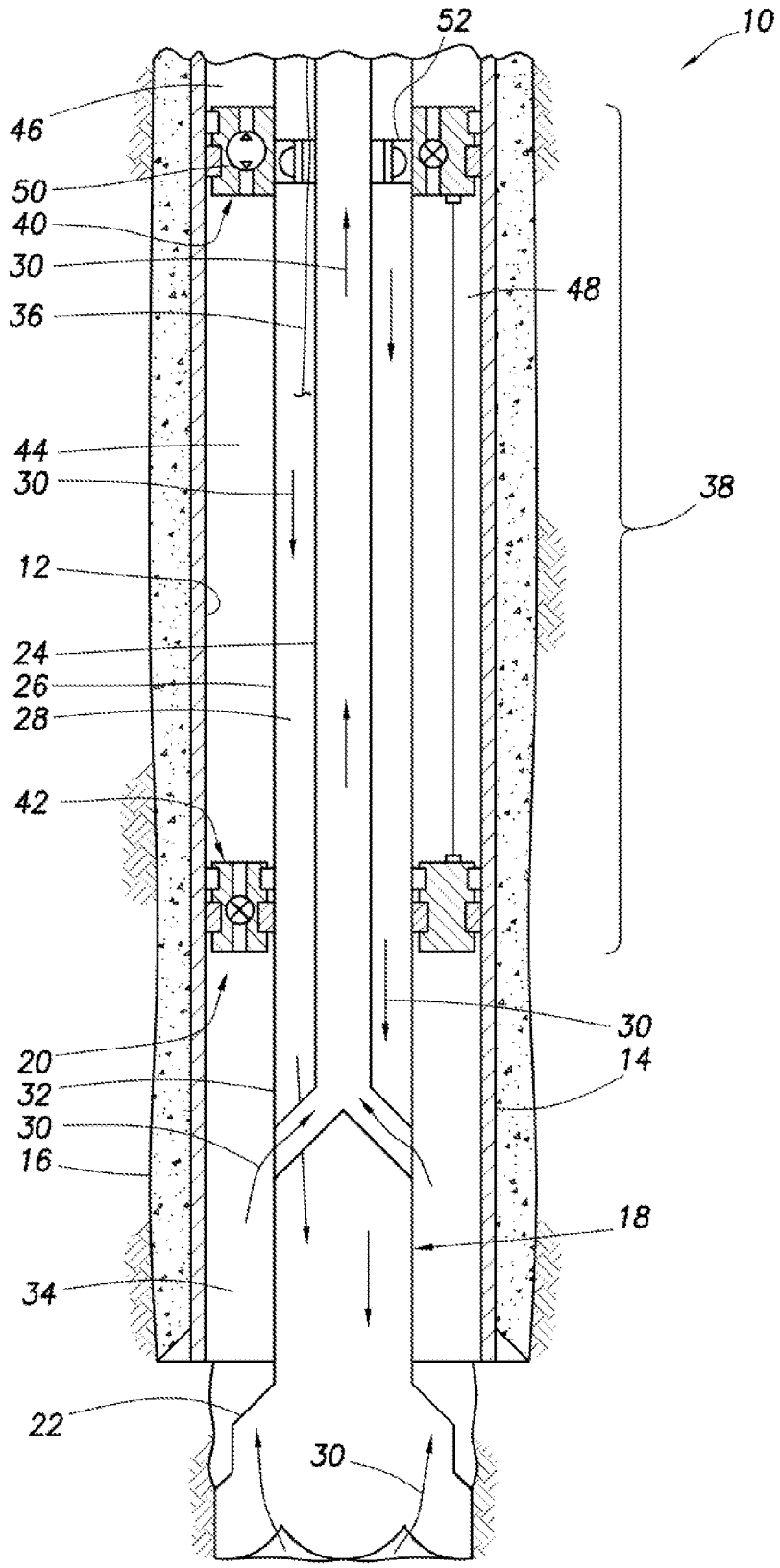
FIG. 1 is a representative cross-sectional view of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is lined with casing 14 and cement 16. It is desired to advance a tubular string 18 through the wellbore 12 and, for this purpose, the well system 10 is provided with a piston tractor system 20.

The term "casing" is used herein to indicate a protective lining for a wellbore. Casing can serve to prevent collapse of a wellbore, to provide pressure isolation, etc. Casing can include tubulars known to those skilled in the art as casing, liner or tubing. Casing can be segmented or continuous, metal or nonmetal, and can be preformed or formed in situ. Any type of tubular may be used, in keeping with the principles of this disclosure.

The piston tractor system 20 may be used to advance the tubular string 18 through the wellbore 12 for a variety of different purposes. In the example depicted in FIG. 1, a drill bit 22 is connected at a distal end of the tubular string 18 for drilling the wellbore further into the earth.

The tubular string 18 is advanced through the wellbore 12, in order to continue to drill the wellbore. In other examples, the tubular string 18 could be displaced in order to expand the casing 14 or another casing, to install casing, to convey completion equipment or other types of equipment through the wellbore 12, etc. The tubular string 18 may be displaced through the wellbore 12 for any purpose, in keeping with the principles of this disclosure.

Note that it is not necessary for the piston tractor system 20 to be positioned in a cased section of the wellbore 12. Instead, the piston tractor system 20 could be positioned in an uncased, open hole section of the wellbore 12 (e.g., the section of the wellbore being drilled in the FIG. 1 example).

As depicted in FIG. 1, the tubular string 18 includes inner and outer tubular elements 24, 26, with an annulus 28 formed radially between the tubular elements. A fluid 30 (such as, a drilling mud, other drilling fluid, etc.) is circulated from a surface location (such as, a rig at the earth's surface, a subsea facility, a floating rig, etc.) to the drill bit 22 via the annulus 28, and is returned via the inner tubular element 24. A crossover tool 32 permits the fluid 30 to enter the inner tubular element 24 from an annulus 34 formed radially between the tubular string 18 and the wellbore 12.

For clarity of illustration and description, additional equipment which may be used in the tubular string 18 is not depicted in FIG. 1. For example, the tubular string 18 could include a drilling motor (also known as a mud motor, e.g., a Moineau-type motor or a turbine) for rotating the drill bit 22, rotary steerable tools, jars, centralizers, reamers, stabilizers, measurement-while-drilling (MWD), pressure-while-drilling (PWD) or logging-while-drilling (LWD) sensors and communication/telemetry devices, etc. Any combination of equipment may be used in the tubular string 18 in keeping with the principles of this disclosure.

Various lines 36 may extend along the tubular string 18. The lines 36 may extend from the surface location to the piston tractor system 20, to the MWD, PWD and/or LWD devices, to the steering tools, and/or to any other equipment.

The lines 36 may include electrical, hydraulic, optical or any other types of lines. The lines may be used for supplying electrical power, for communicating data, commands and/or other types of signals, for sensing parameters in the well environment (such as pressure, temperature, vibration, etc.), for supplying hydraulic fluid and/or pressure, etc. Any purpose may be served by the lines 36 in keeping with the principles of this disclosure.

The lines 36 are depicted in FIG. 1 as extending through the annulus 28 between the tubular elements 24, 26. However, in other examples, the lines 36 may extend through a wall of either of the tubular elements 24, 26, in an interior of the inner tubular element, on an exterior of the outer tubular element, etc. Any positions of the lines 36 may be used, as desired.

In the FIG. 1 example, the piston tractor system 20 includes a set 38 of piston assemblies 40, 42 on the tubular string 18. Each of the piston assemblies 40, 42 is sealingly engaged with both the wellbore 12 and the tubular string 18, and so the piston assemblies divide an annular region formed radially between the wellbore and the tubular string into separate isolated annuli 34, 44, 46.

As mentioned above, the fluid 30 is in the annulus 34. Preferably, another fluid 48 is contained in the annuli 44, 46. This fluid 48 is preferably a clean, debris-free fluid which can readily and reliably be pumped between the annuli 44, 46 by a pump 50 of the piston assembly 40. However, the fluid 48 could be the same as the fluid 30, if desired.

The annulus 46 preferably extends to the surface location, although in other examples described below, another set of piston assemblies 40, 42 could be interposed between the surface location and the set 38 depicted in FIG. 1.

In some examples, an electrical generator 52 (such as a turbine-type or vane-type electrical generator) may be positioned in the annulus 28. The generator 52 generates electricity in response to flow of the fluid 30 through the annulus 28.

The generator 52 can generate electrical power for use by the piston tractor system 20, and/or for use by other equipment in the tubular string 18. Alternatively, electrical power could be supplied to the system 20 by the lines 36, by onboard batteries, or by any other electrical power source. However, electrical power is preferably supplied to the system 20 by conducting electricity through the inner and outer tubular elements 24, 26, as discussed more fully below.

Figure 2:
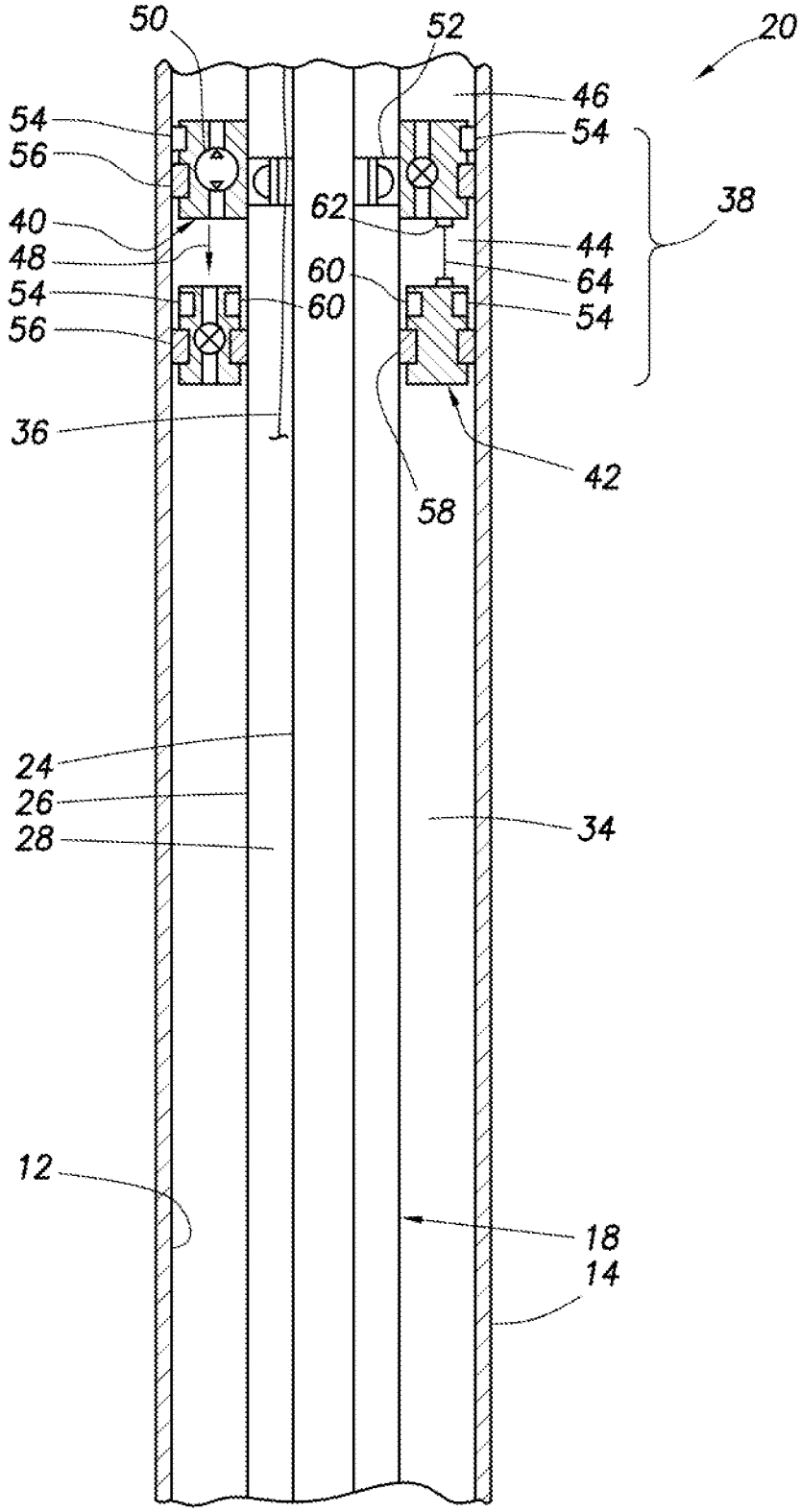
FIGS. 2-4 are representative cross-sectional views of steps in a method of operating a piston tractor system which can embody principles of this disclosure.

Referring additionally now to FIG. 2, the piston tractor system 20 is representatively illustrated, apart from the remainder of the well system 10, other than the wellbore 12, casing 14 and tubular string 18. Note that it is not necessary for the piston tractor system 20 to be used in the well system 10 and method of FIG. 1, since the piston tractor system could be used in any other well systems and methods, as desired.

In the FIG. 2 example, the piston assembly 40 is rigidly secured to the tubular string 18, and the piston assembly 42 is reciprocably disposed on the tubular string. For example, the piston assembly 40 could be integrally formed with the outer tubular element 26, or could be secured thereto with threads, welds, etc.

A section of the piston assembly 40 could comprise a section of the tubular string 18 (e.g., with the generator 52 therein, etc.). Thus, it should be appreciated that any of the elements described herein could be combined with any of the other described elements, and any element could be separated into multiple elements, in keeping with the principles of this disclosure.

Each of the piston assemblies 40, 42 includes one or more gripping devices 54 (such as a brake, slips, etc.) for gripping the wellbore 12. As depicted in FIG. 2, the gripping device 54 on the piston assembly 40 is gripping an interior surface of the casing 14, thereby preventing the tubular string 18 from displacing relative to the wellbore 12. The gripping device 54 on the piston assembly 42 is not grippingly engaged with the wellbore 12.

Each of the piston assemblies 40, 42 also includes a sealing device 56 for sealingly engaging the wellbore 12. The piston assembly 42 includes a sealing device 58 which sealingly engages an outer surface of the tubular string 18.

The piston assembly 42 also includes a gripping device 60 which is capable of grippingly engaging the tubular string 18. However, in the configuration of FIG. 2, the gripping device 60 does not grip the tubular string 18, and so the piston assembly 42 is free to displace axially relative to the tubular string and the wellbore 12.

To displace the piston assembly 42 through the wellbore 12, the pump 50 of the piston assembly 40 is operated to pump the fluid 48 from the annulus 46 to the annulus 44. This increases the volume of the annulus 44. The volume of fluid 48 displaced by the pump 50 is directly related to the distance traversed by the piston assembly 42, and so by measuring this volume, the displacement of the piston assembly can be conveniently measured, as described more fully below.

Alternatively, a displacement sensor 62 (such as, of the type having a line 64 reeled in or out in response to the displacement, with the displacement being measured based on rotation of a spool, etc.) can be used to directly measure relative displacement between the piston assemblies 40, 42, or to directly measure the distance between the piston assemblies. Any manner of determining the relative displacement between the piston assemblies 40, 42, or of measuring the distance between the piston assemblies, may be used, as desired.

The line 64 can also be used to transmit electrical power, data, commands (and/or other types of signals) between the piston assemblies 40, 42. Alternatively, the lines 36 could be used for this purpose.

As mentioned above, the annulus 44 volume increases when the pump 50 displaces the fluid 48 from the annulus 46 to the annulus 44. Since the piston assembly 40 gripping device 54 is grippingly engaged with the wellbore 12 at this point, and the gripping devices 54, 60 of the piston assembly 42 are not grippingly engaged with either the wellbore or the tubular string 18, this causes the piston assembly 42 to displace away from the piston assembly 40 (downward as viewed in FIG. 2).

Figure 3:
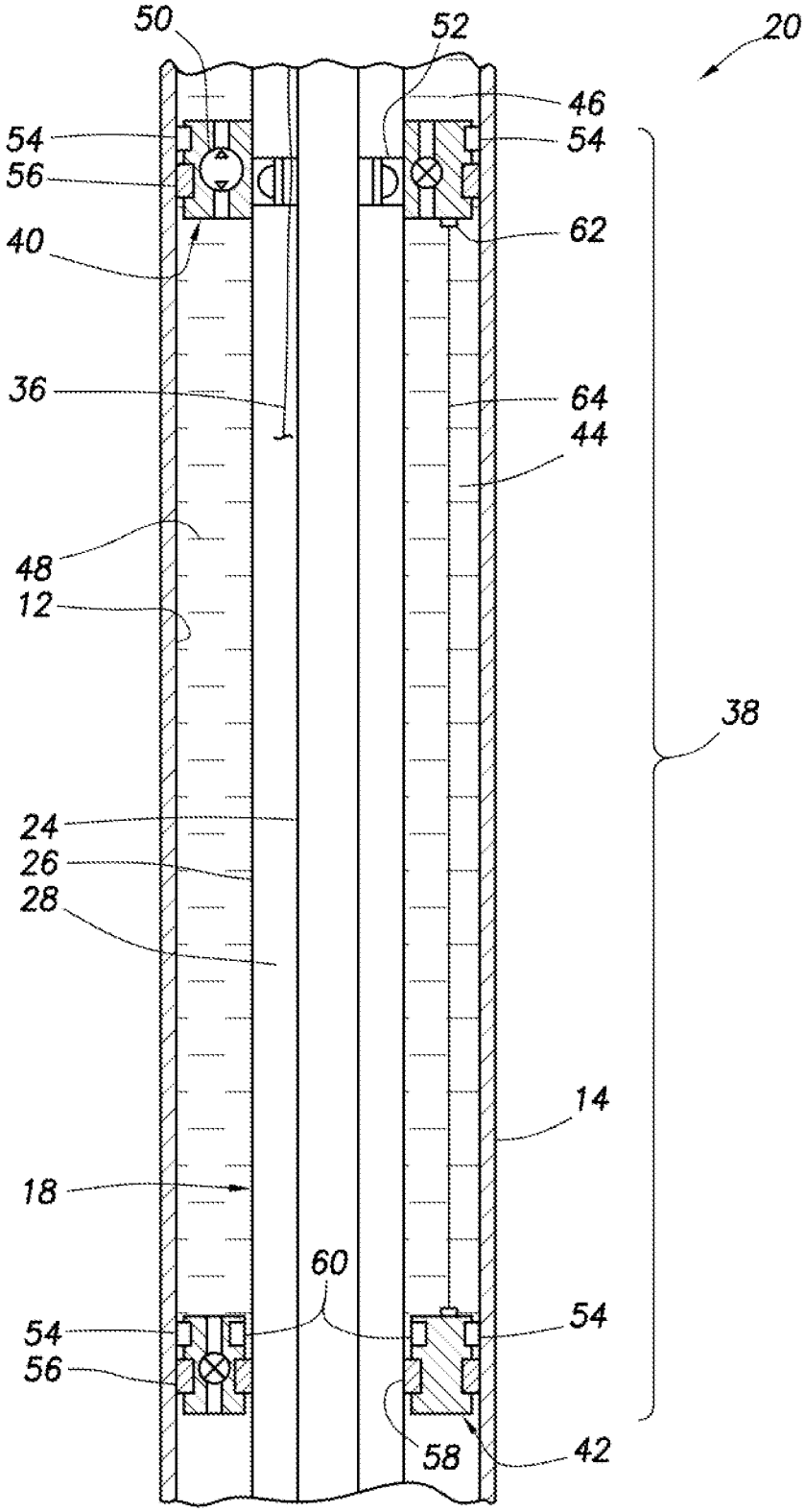

Referring additionally now to FIG. 3, the piston tractor system 20 is representatively illustrated after the piston assembly 42 has been displaced away from the piston assembly 40, due to the axial expansion of the annulus 44. The gripping devices 54 on the piston assembly 42 are now actuated to grippingly engage the wellbore 12 and prevent further displacement of the piston assembly 42.

The sensor 62 can be used to determine when pumping of the fluid 48 into the annulus 44 should cease (e.g., when the piston assembly 42 has reached a predetermined distance away from the piston assembly 40). Alternatively, pumping of the fluid 48 into the annulus 44 could cease when a predetermined volume of the fluid has been pumped, etc.

Note that the gripping devices 54 on the piston assembly 40 remain grippingly engaged with the wellbore 12 at this point, thereby preventing relative displacement between the tubular string 18 and the wellbore. Prior to releasing the gripping devices 54 on the piston assembly 40 (as depicted in FIG. 4 and described more fully below), the gripping devices 60 on the piston assembly 42 could be grippingly engaged with the tubular string 18, so that relative displacement between the tubular string and the wellbore 12 is still prevented.

Figure 4:
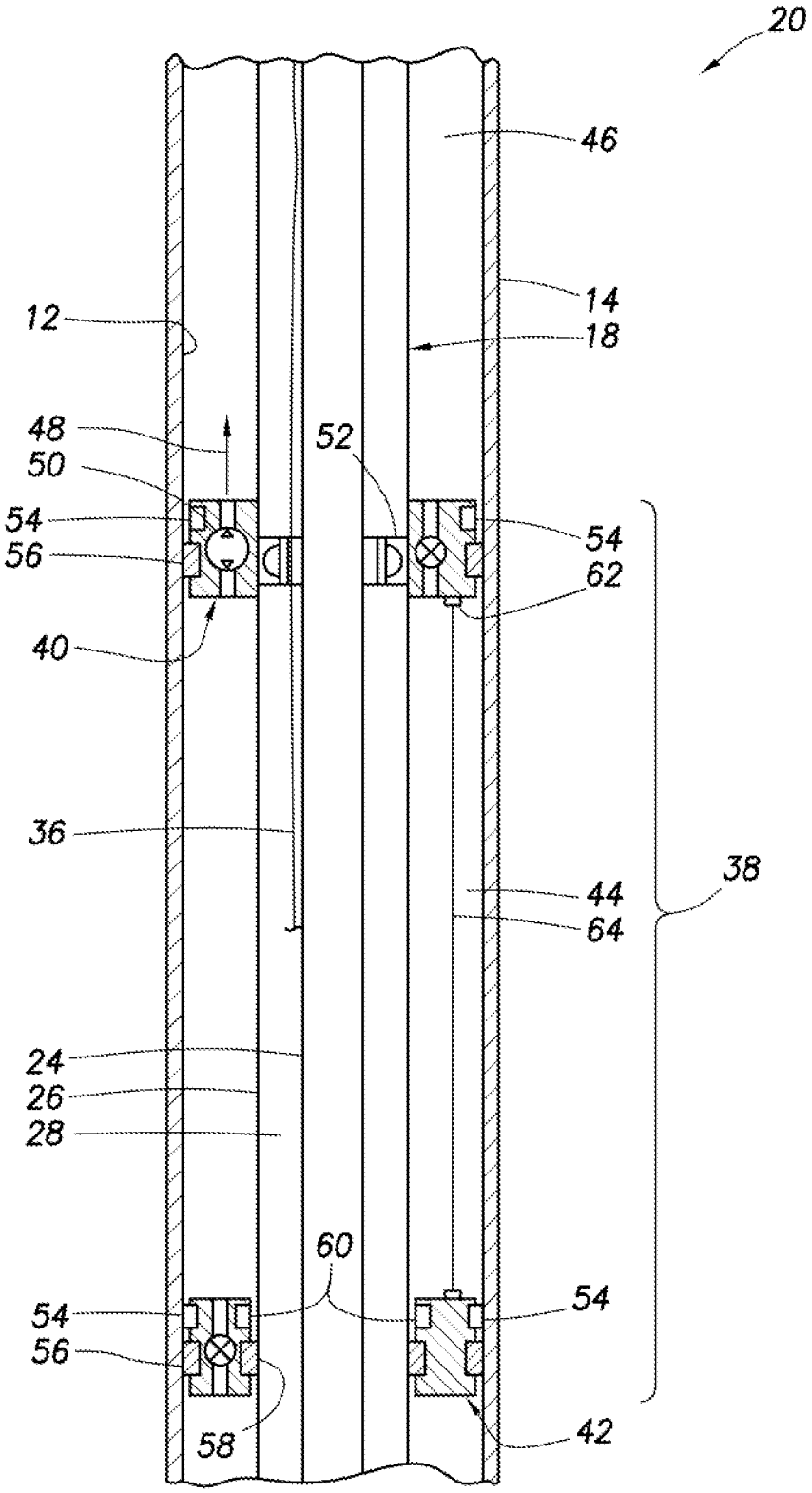

Referring additionally now to FIG. 4, the piston tractor system 20 is representatively illustrated after the gripping devices 54 on the piston assembly 40 have been released from engagement with the wellbore 12. The pump 50 displaces the fluid 48 from the annulus 44 to the annulus 46, thereby decreasing the volume of the annulus 44 and biasing the piston assembly 40 to displace downwardly (as viewed in FIG. 4).

More precisely, a pressure differential across the piston assembly 40 results when the pump 50 displaces the fluid 48 from the annulus 44 to the annulus 46, and this pressure differential biases the piston assembly to displace toward the other piston assembly 42. Note that this pressure differential is created without applying pressure to the annulus 46 from the surface, although as a contingency measure, pressure could be applied to the annulus 46 from the surface to bias the piston assembly 40 to displace through the wellbore 12, if desired.

Prior to operating the pump 50 to displace the fluid 48 from the annulus 44 to the annulus 46, and the piston assembly 40 displacing downward, the gripping devices 60 on the piston assembly 42 are not engaged with the tubular string 18 (if previously engaged, the gripping devices are disengaged at this point). Thus, downward displacement of the piston assembly 40 also results in the desired downward displacement of the tubular string 18 through the piston assembly 42.

When the tubular string 18 and piston assembly 40 have been displaced sufficiently downward toward the piston assembly 42, pumping of the fluid 48 out of the annulus 44 is ceased. The sensor 62 measurement, a measurement of the volume of the fluid 48 displaced, or any other technique may be used to determine when to cease pumping of the fluid 48. As additional examples, displacement of the tubular string 18 and piston assembly 40 can cease when a desired depth has been reached, or when maximum weight has been applied to the drill bit 22.

At this point, the system 20 will have returned to the configuration depicted in FIG. 2, except that the tubular string 18 and the set 38 of piston assemblies 40, 42 will have advanced a certain distance along the wellbore 12. The gripping devices 54 on the piston assembly 40 are engaged with the wellbore 12 to prevent relative displacement between the tubular string 18 and the wellbore 12, and the gripping devices on the piston assembly 42 are then released from engagement with the wellbore, in preparation for again displacing the piston assembly 42 away from the piston assembly 40.

The steps depicted in FIGS. 2-4 and described above can be repeated as desired to advance the tubular string 18 further along the wellbore 12. Furthermore, the steps can be reversed to advance the tubular string 18 in an opposite direction along the wellbore 12.

The tubular string 18 could be retrieved from the well by operating the system 20 in reverse. Thus, the direction of displacement of the tubular string 18 and piston assemblies 40, 42 is not limited to only away from the surface, and it is not necessary for the piston assembly 40 to follow the piston assembly 42 through the wellbore 12 in any particular direction.

Preferably, if the system 20 is used to retrieve the tubular string 18, a surface rig is also used in conjunction with the system to withdraw the tubular string from the well, the surface rig maintaining sufficient tension on an upper section of the tubular string. If the tubular string 18 below the piston tractor system 20 becomes stuck, the piston tractor system can conveniently apply tension to one or more jars positioned between the system and the sticking point.

Figure 5:
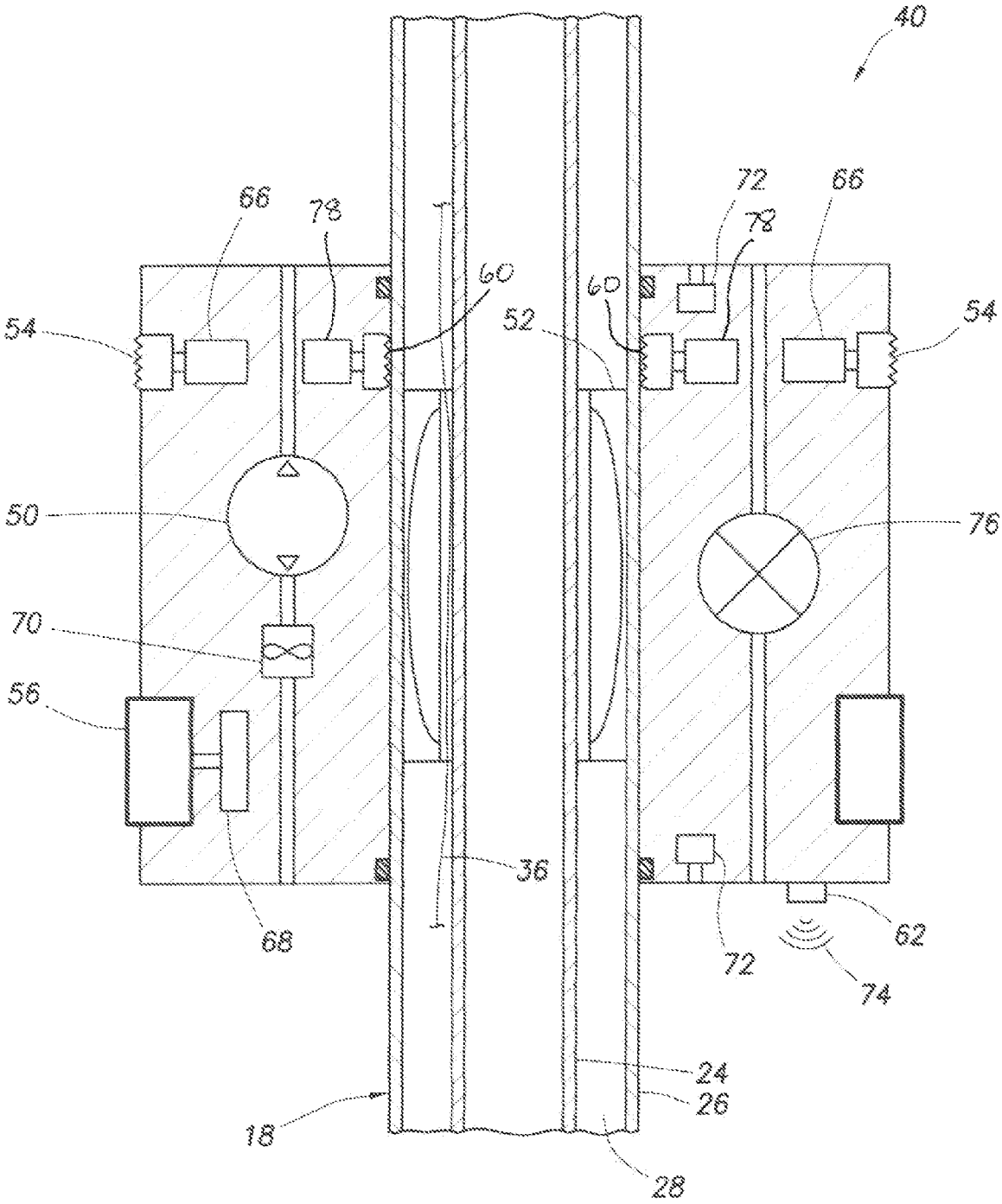
FIG. 5 is an enlarged scale representative cross-sectional view of a piston assembly of the piston tractor system.

Referring additionally now to FIG. 5, an enlarged scale representative cross-sectional view of one example of the piston assembly 40 is representatively illustrated. Further details of the piston assembly 40 are visible in FIG. 5, but it should be clearly understood that the scope of this disclosure is not limited to any particular details of the piston assembly.

In the FIG. 5 example, it may be seen that actuators 66 are used to outwardly extend the gripping devices 54 into engagement with the wellbore 12. The actuators 66 may be any type of actuators (e.g., electrical, hydraulic, etc.).

Similarly, an actuator 68 may be used to outwardly extend the sealing device 56 into sealing engagement with the wellbore 12. For example, the sealing device 56 could comprise an inflatable seal, in which case the actuator 68 could comprise a pump, valves, etc., for controlling inflation of the seal.

Alternatively, an electrical or hydraulic actuator 68 could be used to outwardly extend the sealing device 56. However, it is not necessary for the sealing device 56 to be outwardly extendable or retractable in keeping with the principles of this disclosure, since the sealing device could be configured to resiliently engage the wellbore 12 (for example, the sealing device could comprise one or more cup-type seals, etc.).

A flowmeter 70 measures a volume of the fluid 48 that is pumped by the pump 50. Pressure sensors 72 measure pressure in the annuli 44, 46 on opposite sides of the piston assembly 40.

For example, the pressure sensors 72 can be used to determine a pressure differential across the piston assembly 40 which results from pumping the fluid 48 from the annulus 44 to the annulus 46, and which thereby biases the piston assembly 40 and tubular string 18 to displace through the wellbore 12. This pressure differential can be regulated, to thereby control an axial force applied to the tubular string 18 (and to the drill bit 22 in the system 10 of FIG. 1).

The sensor 62 is depicted in FIG. 5 as comprising an acoustic or ultrasonic range finder of the type which measures a delay between transmitting a signal 74 and receiving the signal reflected off of the piston assembly 42. The signal 74 may also, or alternatively, be used for transmitting data, commands, etc., between the piston assemblies 40, 42.

Any other type of position or displacement sensor may be used for the sensor 62, as desired. For example, the sensor 62 could include an inductive antenna, electromagnetic range finding means or other types of proximity sensors.

The piston assembly 40 also includes a valve 76 which selectively permits and prevents fluid communication between the opposite sides of the piston assembly 40. During the operation of the piston tractor system 20, the valve 76 will preferably remain closed. However, the valve 76 may be opened when relatively unrestricted flow of fluid between the opposite sides of the piston assembly 40 is desired, for example, while conveying the piston tractor system 20 into or out of the well, etc.

As discussed above, the piston assembly 40 is preferably rigidly connected to the tubular string 18 (e.g., by welding, threading, integrally forming, etc.). However, in some circumstances it may be desirable to allow the piston assembly 40 to displace longitudinally relative to the tubular string 18. For this purpose, the piston assembly 40 may be provided with shear pins, a shear ring, or gripping devices 60 and actuators 78 to releasably grip the tubular string 18.

Figure 6:
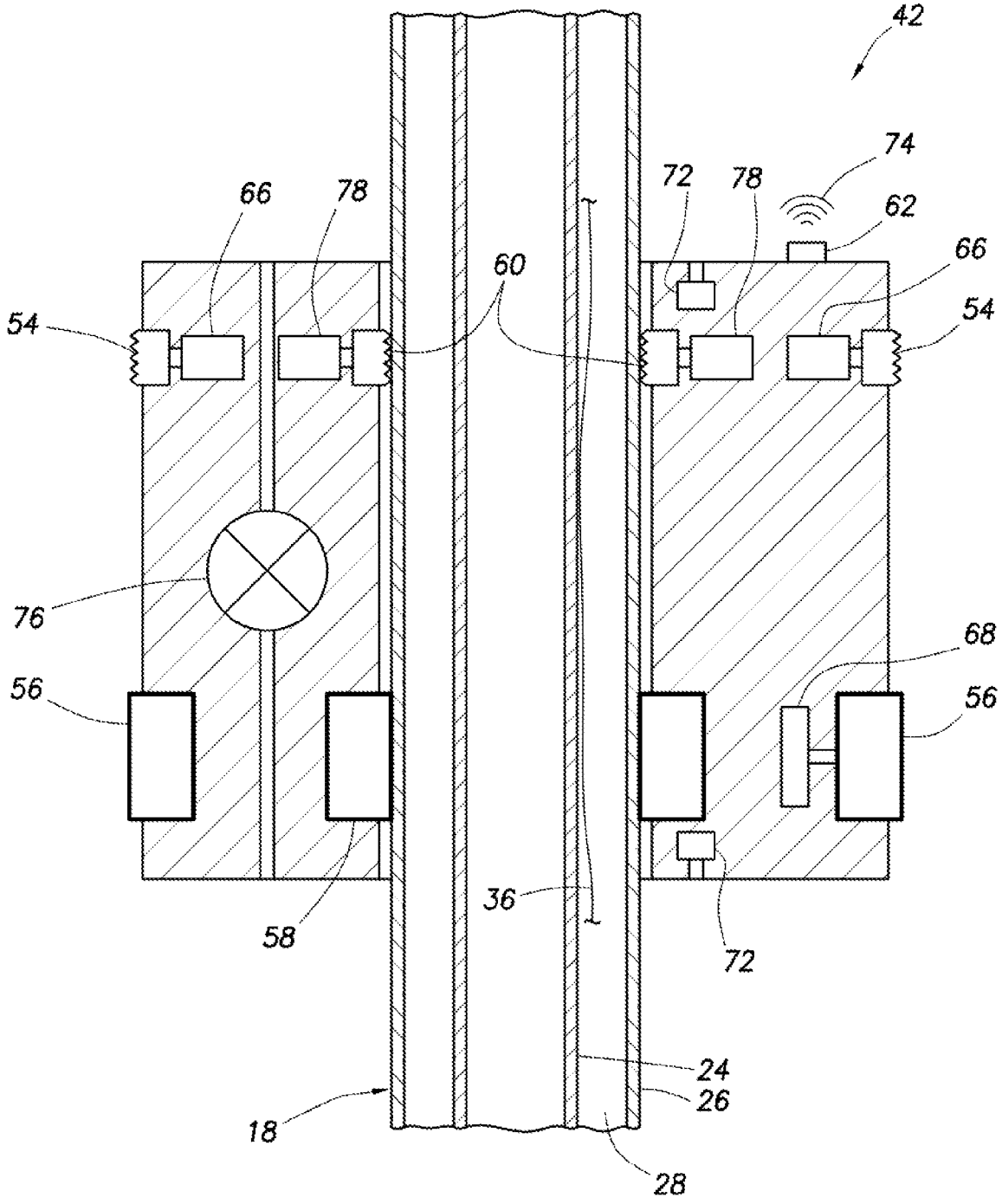
FIG. 6 is a representative cross-sectional view of another piston assembly of the piston tractor system.

Referring additionally now to FIG. 6, a cross-sectional view of one example of the piston assembly 42 is representatively illustrated. In this view, it may be seen that this example of the piston assembly 42 includes gripping devices 54, sealing device 56, actuators 66, actuator 68, sensor 62, sensors 72 and valve 76, as in the piston assembly 40 described above.

The piston assembly 42 also includes the sealing device 58 and gripping devices 60 for sealing and grippingly engaging, respectively, the tubular string 18. Actuators 78 (similar to the actuators 66) are used to extend the gripping devices 60 into gripping engagement with the tubular string 18. If desired, an actuator (similar to the actuator 68) could be used to extend the sealing device 58 into sealing contact with the tubular string 18.

The valve 76 in the piston assembly 42 selectively permits and prevents fluid communication between the annuli 44, 34 on opposite sides of the piston assembly. As with the valve 76 of the piston assembly 40, the valve of the piston assembly 42 is preferably closed during the steps of advancing the tubular string 18 through the wellbore 12.

Figure 7:
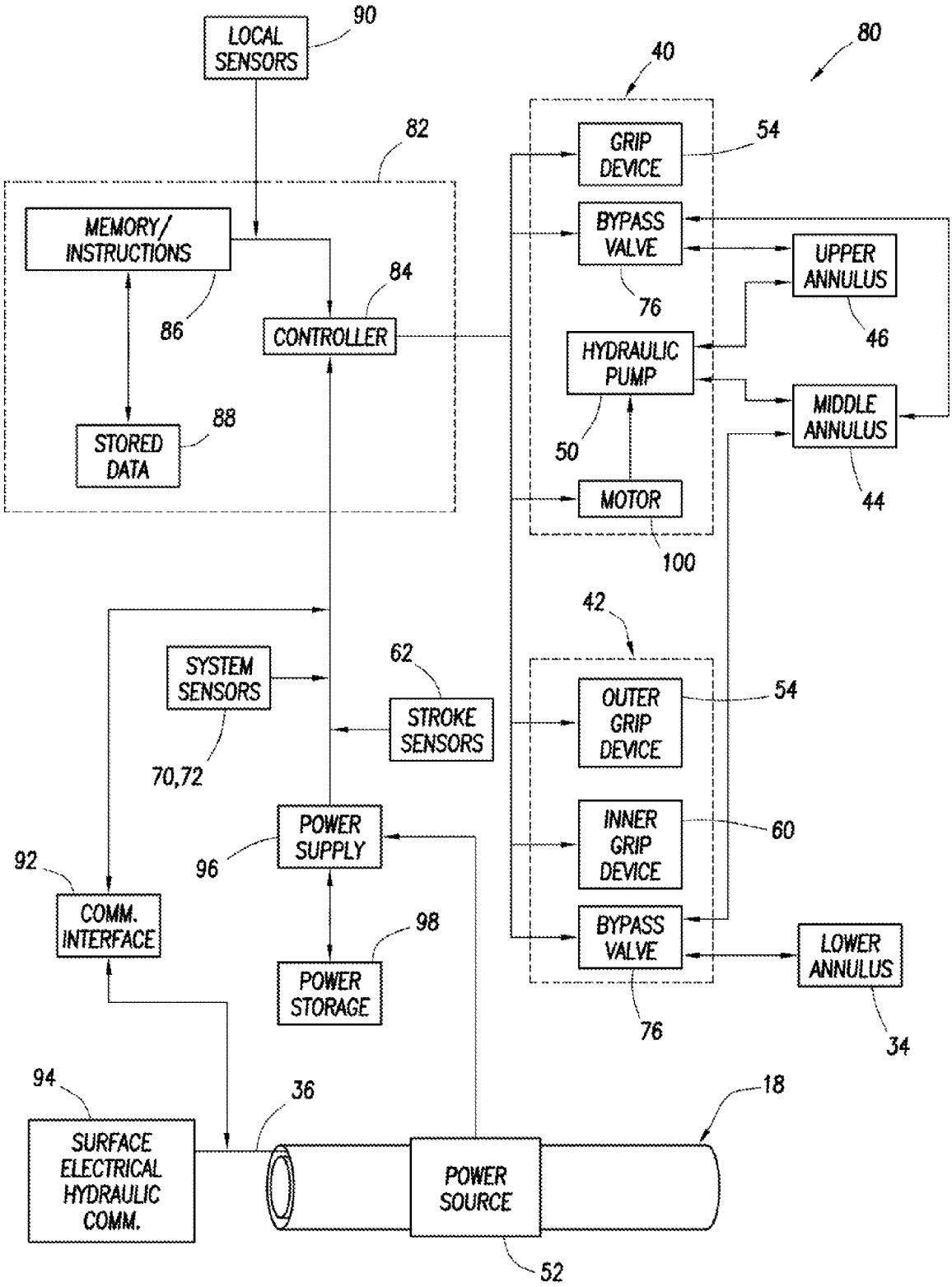
FIG. 7 is a representative schematic view of a control system which can be used with the piston tractor system.

Referring additionally now to FIG. 7, a control system 80 for controlling operation of the piston tractor system 20 is representatively illustrated. A control module 82 comprises a controller 84 (such as a programmable processor, a programmable logic controller, etc.), memory 86 and data storage 88 connected via a communications interface 92 to a surface electrical, hydraulic, etc., communication facility 94 via the lines 36. The control module 82 may be positioned in the piston assembly 40, or at another location.

The control module 82 receives input from the various sensors 62, 70, 72 (as well as other local sensors 90, such as sensors of MWD, PWD and/or LWD tools, including measurements of weight on bit, thrust, tension, torque, bend, vibration, rate of penetration, etc.), and receives electrical power from a power supply 96. The power supply 96 can receive the electrical power from a power source (such as the generator 52), and/or from power storage 98 (such as batteries, etc.). The power supply 96 can also provide for charging the power storage 98 while the generator 52 is generating electricity, and supplying power to the control module 82 from the power storage while the generator is not generating electricity.

Preferably, the inner and outer tubular elements 24, 26 are used as conductors for conducting electricity to the piston tractor system 20. In this manner, the downhole generator 52 and/or power storage 98 may not be needed. Data and commands may also be transmitted via the inner and outer tubular elements 24, 26, with two-way communication between the piston assemblies 40, 42 and a remote location (such as the earth's surface, a subsea facility, a floating vessel, etc.).

A technique for using inner and outer tubular elements as conductors is described in International Application No. PCT/US12/20929 filed on 11 Jan. 2012. In this technique, the crossover tool 32 (also known as a diverter) is provided with electrically insulative material interposed between the inner and outer tubular elements 24, 26, so that the tubular elements can be used as conductors in a well.

The stored data 88 can include performance data and data obtained from the sensors 62, 70, 72, 90 for post-job retrieval. The memory 86 can have instructions saved therein for use by the controller 84, well-specific data, parameters and algorithms for determining how the piston assemblies 40, 42 should be operated in the system 20 (e.g., desired force to be applied to the drill bit 22 during drilling), etc. For example, the instructions could include a routine for causing the piston assemblies 40 42 to be automatically operated to advance the tubular string 18 along the wellbore 12 as depicted in FIGS. 2-4.

Operation of the piston assembly 40 gripping device 54, bypass valve 76 and hydraulic pump 50 are controlled by the control module 82. The control module 82 can control operation of the pump 50 by controlling operation of a motor 100 (such as an electrical or hydraulic motor) which drives the pump.

Operation of the piston assembly 42 gripping devices 54, 60 and bypass valve 76 are also controlled by the control module 82. Although not illustrated in FIG. 7, the control module 82 can also control operation of the actuators 68 of the piston assemblies 40, 42, if the actuators 68 are used.

The surface communications facility 94 can be in communication with a remote location (such as, an office at another location, etc.) via telephone, Internet, satellite, wireless or any other form of communication. Commands from the remote location can be communicated via the communications facility 94 and lines 36 to the control module 82, thereby allowing for remote control of the operation.

Operation of the pump 50 can be automatically controlled with a closed loop feedback technique, so that certain drilling parameters are maintained within desired limits, or so that optimum drilling performance is achieved. For example, the pump 50 could be operated so that weight on bit is maintained in a desired range, with the weight on bit being detected by the sensors 90 of MWD or LWD tools.

As another example, the pump 50 could be operated so that the rate of penetration is optimized, or the sensed vibration, stick-slip, etc. is minimized. This control over operation of the pump 50 (e.g., enabling local control over the force applied to the drill bit 22) can significantly enhance the efficiency of the drilling operation.

Figure 8:
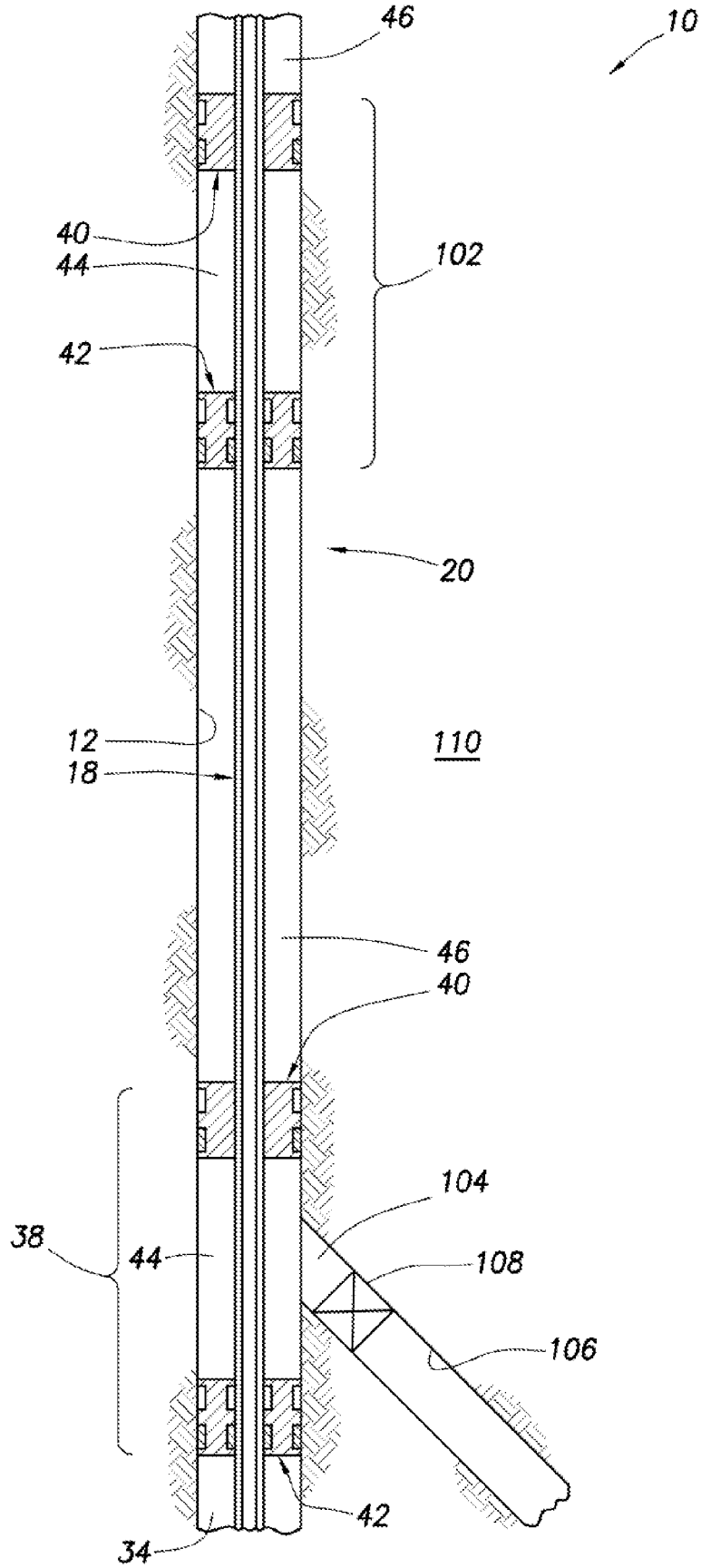
FIG. 8 is a representative cross-sectional view of another configuration of the piston tractor system.

Referring additionally now to FIG. 8, another example of the piston tractor system 20 is representatively illustrated in the well system 10. In this example, two sets 38, 102 of the piston assemblies 40, 42 are used on the tubular string 18.

One advantage of including multiple sets 38, 102 of the piston assemblies 40, 42 is that, if one set encounters a leak path 104 along the wellbore 12, the other set can be used to advance the tubular string 18 along the wellbore, at least until the first set traverses the leak path. In the FIG. 8 example, the set 38 is traversing the leak path 104, which is in the form of a lateral or branch wellbore 106 which intersects the wellbore 12.

The leak path 104 in this case can allow fluid to flow around the piston assemblies 40, 42 (e.g., preventing complete sealing of the sealing devices 56 with the wellbore 12) and the leak path can allow escape of the fluid into the lateral wellbore 106, thereby preventing proper operation of the set 38 of piston assemblies. A plug 108 can be set in the wellbore 106 to prevent escape of fluid into the wellbore 106, but fluid can still flow around the piston assemblies 40, 42 when the piston assemblies traverse the leak path 104. Other types of leak paths can include washouts, underreamed sections, perforated sections, etc.

When a leak path is encountered, the set 38 of piston assemblies 40, 42 can be deactivated (e.g., by retracting the gripping devices 54 and sealing devices 56 of each piston assembly, and opening the valves 76), thereby allowing the piston assemblies to be displaced with the tubular string 18 through the wellbore 12. Prior to deactivating the set 38, the set 102 of piston assemblies 40, 42 can be activated (e.g., by extending the gripping devices 54 and sealing devices 56 of each piston assembly, and closing the valves 76), thereby allowing the set 102 to be operated to advance the tubular string 18 through the wellbore 12.

After the leak path 104 is traversed by the set 38, that set can be activated, and the set 102 can be deactivated, if desired. Similarly, the set 38 can be used to advance the tubular string 18 through the wellbore 12 when the set 102 traverses the leak path 104.

Note that, in the system 10 example of FIG. 8, the piston assemblies 40, 42 are positioned in an uncased section of the wellbore 12. This can be accomplished where an earth formation 110 penetrated by the wellbore 12 is substantially impermeable and an inner surface of the wellbore is smooth enough for the sealing devices 56 to sealingly engage.

In another example representatively illustrated in FIG. 9, an uncased section of the wellbore 12 below casing 14 is not conducive to sealing engagement between the piston assemblies 40, 42 and the wellbore (e.g., the formation 110 is permeable, the wellbore is not sufficiently smooth, etc.). In this situation, the set 102 of piston assemblies 40, 42 can be used to advance the tubular string 18 through the wellbore 12 while the set 38 is in the uncased section.

Furthermore, the uncased section of the wellbore 12 can have a smaller diameter as compared to the cased section of the wellbore. To allow the set 38 of piston assemblies 40, 42 to readily enter and displace through the uncased section, the diameters of the piston assemblies 40, 42 can be reduced. For example, the actuators 66, 68 can be operated to inwardly retract the respective gripping devices 54 and sealing devices 56, so that the diameters of the piston assemblies 40, 42 are less than the diameter of the uncased section of the wellbore 12.

Note that the wellbore 12 can have a reduced diameter at locations other than at an uncased section. For example, the wellbore 12 diameter can be reduced due to partial collapse of the casing 14, the presence of a casing patch, etc. In any circumstance where a reduced diameter of the wellbore 12 is encountered, one set of piston assemblies 40, 42 can be used to displace the tubular string 18 through the wellbore while the other set of piston assemblies traverses the reduced diameter section.

Figure 9:
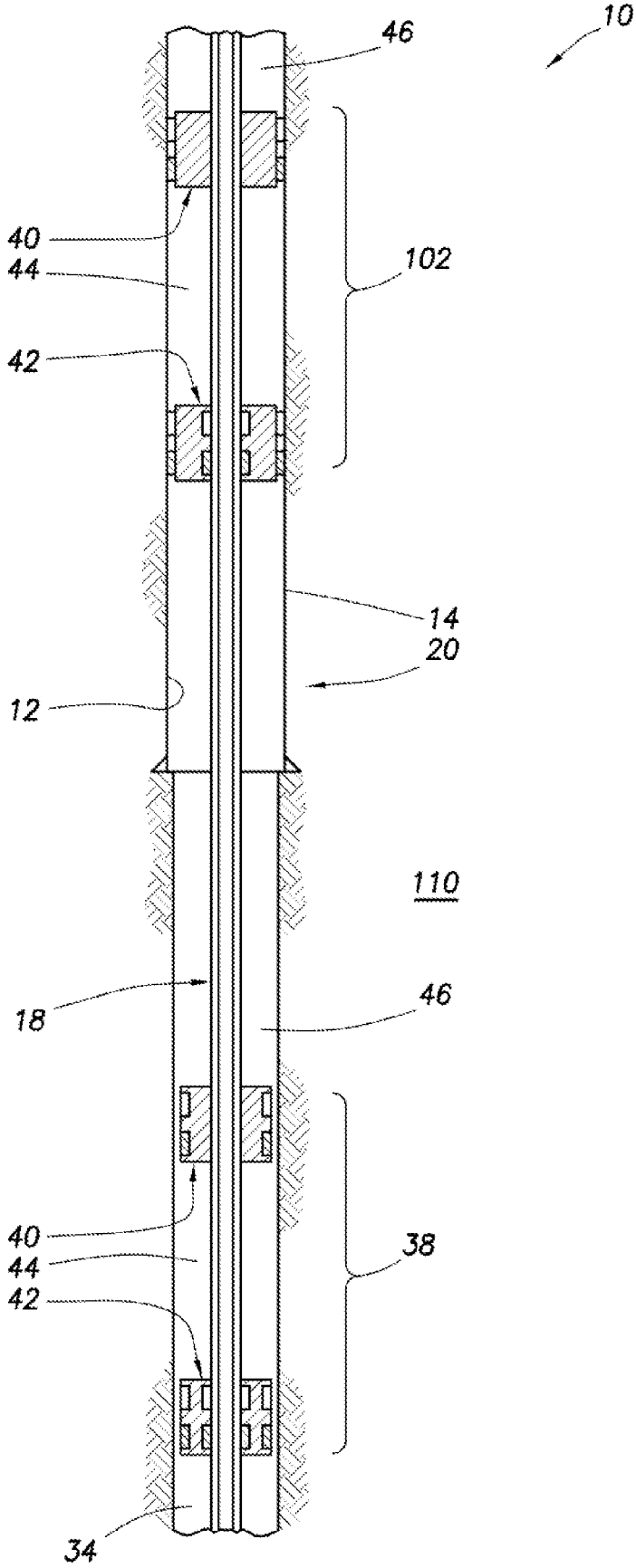
FIG. 9 is a representative cross-sectional view of yet another configuration of the piston tractor system.

Although only two sets 38, 102 of the piston assemblies 40, 42 are depicted in FIGS. 8 & 9, it is envisioned that any number of sets may be used in the system 20. For example, multiple sets of piston assemblies 40, 42 could be used simultaneously to increase the force applied to displace the tubular string 18. The lines 36 can be useful in this respect, by enabling the multiple sets of piston assemblies to work together in concert as an integrated system 20.

Although the piston assembly 40 is described above as being rigidly attached to the tubular string 18 in some examples, in other examples the piston assembly 40 could be provided with gripping devices 60 as in the piston assembly 42, so that the piston assembly 40 can be decoupled from the tubular string 18 displacement, if desired. For example, if the piston assemblies 40, 42 cannot pass through a reduced diameter section of the wellbore 12, both of the piston assemblies could be decoupled from the tubular string (by disengaging the gripping devices 60 of each piston assembly), thereby allowing the tubular string to continue to advance (e.g., by operation of another set of piston assemblies).

It may now be fully appreciated that the above disclosure provides significant advancements to the art of constructing and operating a piston tractor system in a well. In examples described above, the tubular string 18 can be conveniently and reliably advanced in any direction through the wellbore 12. The pump 50 of the piston assembly 40 transfers the fluid 48 back and forth between the annuli 44, 46 to thereby expand and contract the annulus 44 between the piston assemblies 40, 42.

A piston tractor system 20 is provided to the art by the disclosure above. In one example, the system 20 can include a first set 38 of first and second piston assemblies 40, 42 which sealingly engage a wellbore 12, and a pump 50 which transfers a first fluid 48 between a first annulus 44 isolated between the first and second piston assemblies 40, 42, and a second annulus 46.

The wellbore 12 may be lined with a casing 14. The first and second piston assemblies 40, 42 can sealingly engage an interior surface of the casing 14. In other examples, the piston assemblies 40, 42 can sealingly engage an uncased section of the wellbore 12.

At least the second piston assembly 42 may slidingly engage the wellbore 12. At least the second piston assembly 42 may selectively grippingly engage a tubular string 18 extending through the second piston assembly 42.

The tubular string 18 can comprise inner and outer tubular elements 24, 26, with a third annulus 28 formed between the inner and outer tubular elements 24, 26. A second fluid 30 may be flowed into a well via one of the inner tubular element 24 and the third annulus 28, and the second fluid 30 may be flowed out of the well via the other of the inner tubular element 24 and the third annulus 28.

The second annulus 46 may extend to a surface location.

The system 20 can also include a second set 102 of the first and second piston assemblies 40, 42. The first and second sets 38, 102 may be incorporated in a same tubular string 18.

The first piston assembly 40 can include a first valve 76 which selectively permits and prevents fluid communication between the first and second annuli 44, 46. The second piston assembly 42 can include a second valve 76 which selectively permits and prevents fluid communication between the first annulus 44 and a third annulus 34.

At least one of the first and second piston assemblies 40, 42 may include a sensor 62 which senses a distance between the first and second piston assemblies 40, 42.

Each of the first and second piston assemblies 40, 42 can include a first gripping device 54 which selectively grips the wellbore 12. At least the second piston assembly 42 can include a second gripping device 60 which selectively grips a tubular string 18 that extends through the second piston assembly 42. The first piston assembly 40 may also include a second gripping device 60 which selectively grips the tubular string 18.

Electrical power may be supplied from the first piston assembly 40 to the second piston assembly 42.

An outer diameter of the first and second piston assemblies 40, 42 can selectively contract.

At least the first piston assembly 40 can include a flowmeter 70 which detects a flow output of the pump 50.

The first piston assembly 40 may be rigidly secured to a tubular string 18. The second piston assembly 42 may reciprocate on the tubular string 18.

Also described above is a method of operating a piston tractor system 20. In one example, the method can include: sealingly engaging a first set 38 of first and second piston assemblies 40, 42 with a wellbore 12; grippingly engaging the second piston assembly 42 with the wellbore 12; and then pumping a first fluid 48 from a first annulus 44 formed between the first and second piston assemblies 40, 42, while the first piston assembly 40 is secured to a tubular string 18, thereby biasing the tubular string 18 to displace through the second piston assembly 42.

The method can also include: grippingly engaging the first piston assembly 40 with the wellbore 12; then releasing the second piston assembly 42 from gripping engagement with the wellbore 12; and then pumping the first fluid 48 from a second annulus 46 to the first annulus 44, thereby displacing the second piston assembly 42 away from the first piston assembly 40.

The method can include releasing the first piston assembly 40 from gripping engagement with the wellbore 12, prior to the pumping the first fluid 48 from the first annulus 44.

The method can include reducing diameters of the first and second piston assemblies 40, 42 prior to displacing the first and second piston assemblies 40, 42 into a reduced diameter portion of the wellbore 12.

The method can include sealingly engaging a second set 102 of the first and second piston assemblies 40, 42 with the wellbore 12.

The method can include the second set 102 displacing the tubular string 18 through the wellbore 12 while the first set 38 traverses a leak path 104.

The method can include the second set 102 displacing the tubular string 18 through the wellbore 12 while the first set 38 is in a reduced diameter portion of the wellbore 12.

The method can include sensing a distance between the first and second piston assemblies 40, 42 while there is relative displacement between the first and second piston assemblies 40, 42.

The above disclosure also describes a method of advancing a tubular string 18 through a wellbore 12. In one example, the method can include: sealingly engaging first and second piston assemblies 40, 42 with the wellbore 12, each of the first and second piston assemblies 40, 42 including a first gripping device 54 which selectively grips the wellbore 12, and the second piston assembly 42 including a second gripping device 60 which selectively grips the tubular string 18.

The method can include conducting electricity through each of the inner and outer tubular elements 24, 26, thereby supplying electrical power to at least one of the first and second piston assemblies 40, 42.

The method can include a sensor 90 sensing a drilling operation parameter, and wherein the pumping is regulated in response to the sensed drilling operation parameter. The pumping may be automatically regulated in response to the sensed drilling operation parameter. The drilling operation parameter may comprise at least one of weight on bit, thrust, tension, torque, bend, vibration, rate of penetration and stick-slip.

The pumping can be regulated so that the drilling operation parameter is maintained within a desired range, so that the drilling operation parameter is optimized, so that the drilling operation parameter is maximized, or so that the drilling operation parameter is minimized.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A piston tractor system, comprising:

a first set of first and second piston assemblies which sealingly engage a wellbore, thereby pressure isolating first and second annuli formed radially between a tubular string and the wellbore, the first annulus extending between the first and second piston assemblies, wherein each of the first and second piston assemblies includes a first gripping device which selectively grips the wellbore; and a pump which transfers a first fluid between the first annulus, and the second annulus.

2. The system of claim 1, wherein the wellbore is lined with a casing, and wherein the first and second piston assemblies sealingly engage an interior surface of the casing.

3. The system of claim 1, wherein at least the second piston assembly slidingly engages the wellbore.

4. The system of claim 1, wherein at least the second piston assembly selectively grippingly engages the tubular string.

5. The system of claim 4, wherein the tubular string comprises inner and outer tubular elements, with a third annulus formed between the inner and outer tubular elements, and wherein a second fluid is flowed into a well via one of the inner tubular element and the third annulus, and the second fluid is flowed out of the well via the other of the inner tubular element and the third annulus.

6. The system of claim 5, wherein electricity is conducted through each of the inner and outer tubular elements, whereby electrical power is supplied to at least one of the first and second piston assemblies.

7. The system of claim 1, wherein the second annulus extends to a surface location.

8. The system of claim 1, further comprising a second set of the first and second piston assemblies, the first and second sets being incorporated in the same tubular string.

9. The system of claim 1, wherein the first piston assembly includes a first valve which selectively permits and prevents fluid communication between the first and second annuli, and wherein the second piston assembly includes a second valve which selectively permits and prevents fluid communication between the first annulus and a third annulus.

10. The system of claim 1, wherein at least one of the first and second piston assemblies includes a sensor which senses a distance between the first and second piston assemblies.

11. The system of claim 1, wherein at least the second piston assembly includes a second gripping device which selectively grips the tubular string.

12. The system of claim 1, wherein each of the first and second piston assemblies includes a second gripping device which selectively grips the tubular string.

13. The system of claim 1, wherein electrical power is supplied from the first piston assembly to the second piston assembly.

14. The system of claim 1, wherein an outer diameter of the first and second piston assemblies selectively contracts.

15. The system of claim 1, wherein at least the first piston assembly includes a flowmeter which detects a flow output of the pump.

16. The system of claim 1, wherein the first piston assembly is rigidly secured to the tubular string, and wherein the second piston assembly reciprocates on the tubular string.

17. The system of claim 1, further comprising a sensor which senses a drilling operation parameter, and wherein the pump is operated in response to the sensed drilling operation parameter.

18. The system of claim 17, wherein the pump is automatically operated in response to the sensed drilling operation parameter.

19. The system of claim 17, wherein the drilling operation parameter comprises at least one of the group comprising weight on bit, thrust, tension, torque, bend, vibration, rate of penetration, and stick-slip.

20. The system of claim 17, wherein the pump is operated so that the drilling operation parameter is maintained within a desired range.

21. The system of claim 17, wherein the pump is operated so that the drilling operation parameter is optimized.

22. The system of claim 17, wherein the pump is operated so that the drilling operation parameter is maximized.

23. The system of claim 17, wherein the pump is operated so that the drilling operation parameter is minimized.

24. A method of operating a piston tractor system, the method comprising:

sealingly engaging a first set of first and second piston assemblies with a wellbore, thereby pressure isolating first and second annuli formed radially between a tubular string and the wellbore, the first annulus extending between the first and second piston assemblies;

grippingly engaging the second piston assembly with the wellbore; and then pumping a first fluid from the first annulus, while the first piston assembly is secured to the tubular string, thereby biasing the tubular string to displace through the second piston assembly.

25. The method of claim 24, further comprising:

grippingly engaging the first piston assembly with the wellbore;

then releasing the second piston assembly from gripping engagement with the wellbore; and then pumping the first fluid from the second annulus to the first annulus, thereby displacing the second piston assembly away from the first piston assembly.

26. The method of claim 25, wherein the second annulus extends to a surface location.

27. The method of claim 24, further comprising releasing the first piston assembly from gripping engagement with the wellbore, prior to the pumping the first fluid from the first annulus.

28. The method of claim 24, further comprising reducing diameters of the first and second piston assemblies prior to displacing the first and second piston assemblies into a reduced diameter portion of the wellbore.

29. The method of claim 24, further comprising sealingly engaging a second set of the first and second piston assemblies with the wellbore.

30. The method of claim 29, further comprising the second set displacing the tubular string through the wellbore while the first set traverses a leak path.

31. The method of claim 29, further comprising the second set displacing the tubular string through the wellbore while the first set is in a reduced diameter portion of the wellbore.

32. The method of claim 24, further comprising sensing a distance between the first and second piston assemblies while there is relative displacement between the first and second piston assemblies.

33. The method of claim 24, wherein the wellbore is lined with a casing, and wherein the first and second piston assemblies sealingly engage an interior surface of the casing.

34. The method of claim 24, wherein at least the second piston assembly slidingly engages the wellbore.

35. The method of claim 24, wherein at least the second piston assembly selectively grippingly engages the tubular string.

36. The method of claim 24, wherein the tubular string comprises inner and outer tubular elements, wherein a third annulus is formed between the inner and outer tubular elements, and wherein a second fluid is flowed into a well via one of the inner tubular element and the third annulus, and the second fluid is flowed out of the well via the other of the inner tubular element and the third annulus.

37. The method of claim 36, further comprising conducting electricity through each of the inner and outer tubular elements, thereby supplying electrical power to at least one of the first and second piston assemblies.

38. The method of claim 24, further comprising a second set of the first and second piston assemblies, the first and second sets being incorporated in the same tubular string.

39. The method of claim 24, wherein the first piston assembly includes a first valve which selectively permits and prevents fluid communication between the first annulus and the second annulus, and wherein the second piston assembly includes a second valve which selectively permits and prevents fluid communication between the first annulus and a third annulus.

40. The method of claim 24, wherein each of the first and second piston assemblies includes a first gripping device which selectively grips the wellbore.

41. The method of claim 40, wherein at least the second piston assembly includes a second gripping device which selectively grips the tubular string.

42. The method of claim 40, wherein each of the first and second piston assemblies includes a second gripping device which selectively grips the tubular string.

43. The method of claim 24, further comprising supplying electrical power from the first piston assembly to the second piston assembly.

44. The method of claim 24, further comprising a sensor sensing a drilling operation parameter, and the pump being operated in response to the sensed drilling operation parameter.

45. The method of claim 44, wherein the pump is automatically operated in response to the sensed drilling operation parameter.

46. The method of claim 44, wherein the drilling operation parameter comprises at least one of the group comprising weight on bit, thrust, tension, torque, bend, vibration, rate of penetration, and stick-slip.

47. The method of claim 44, wherein the pump is operated so that the drilling operation parameter is maintained within a desired range.

48. The method of claim 44, wherein the pump is operated so that the drilling operation parameter is optimized.

49. The method of claim 44, wherein the pump is operated so that the drilling operation parameter is maximized.

50. The method of claim 44, wherein the pump is operated so that the drilling operation parameter is minimized.

51. A method of advancing a tubular string through a wellbore, the method comprising:

sealingly engaging first and second piston assemblies with the wellbore, thereby pressure isolating first and second annuli formed radially between the tubular string and the wellbore, the first annulus extending between the first and second piston assemblies, each of the first and second piston assemblies including a first gripping device which selectively grips the wellbore, and the second piston assembly including a second gripping device which selectively grips the tubular string.

52. The method of claim 51, further comprising:

grippingly engaging the second piston assembly with the wellbore; and then pumping a first fluid from the first annulus, while the first piston assembly is secured to the tubular string, thereby biasing the tubular string to displace through the second piston assembly.

53. The method of claim 52, further comprising:

grippingly engaging the first piston assembly with the wellbore;

then releasing the second piston assembly from gripping engagement with the wellbore; and then pumping the first fluid from the second annulus to the first annulus, thereby displacing the second piston assembly away from the first piston assembly.

54. The method of claim 53, wherein the second annulus extends to a surface location.

55. The method of claim 52, further comprising releasing the first piston assembly from gripping engagement with the wellbore, prior to the pumping the first fluid from the first annulus.

56. The method of claim 51, further comprising a sensor sensing a drilling operation parameter, and wherein the pumping is regulated in response to the sensed drilling operation parameter.

57. The method of claim 56, wherein the pumping is automatically regulated in response to the sensed drilling operation parameter.

58. The method of claim 56, wherein the drilling operation parameter comprises at least one of the group comprising weight on bit, thrust, tension, torque, bend, vibration, rate of penetration, and stick-slip.

59. The method of claim 56, wherein the pumping is regulated so that the drilling operation parameter is maintained within a desired range.

60. The method of claim 56, wherein the pumping is regulated so that the drilling operation parameter is optimized.

61. The method of claim 56, wherein the pumping is regulated so that the drilling operation parameter is maximized.

62. The method of claim 56, wherein the pumping is regulated so that the drilling operation parameter is minimized.

63. The method of claim 51, further comprising reducing diameters of the first and second piston assemblies prior to displacing the first and second piston assemblies into a reduced diameter portion of the wellbore.

64. The method of claim 51, further comprising sealingly engaging a second set of the first and second piston assemblies with the wellbore.

65. The method of claim 64, further comprising the second set displacing the tubular string through the wellbore while the first set traverses a leak path.

66. The method of claim 64, further comprising the second set displacing the tubular string through the wellbore while the first set is in a reduced diameter portion of the wellbore.

67. The method of claim 51, further comprising sensing a distance between the first and second piston assemblies, while there is relative displacement between the first and second piston assemblies.

68. The method of claim 51, wherein the wellbore is lined with a casing, and wherein the first and second piston assemblies sealingly engage an interior surface of the casing.

69. The method of claim 51, wherein at least the second piston assembly slidingly engages the wellbore.

70. The method of claim 51, wherein the tubular string comprises inner and outer tubular elements, wherein a third annulus is formed between the inner and outer tubular elements, and wherein a fluid is flowed into a well via one of the inner tubular element and the third annulus, and the fluid is flowed out of the well via the other of the inner tubular element and the third annulus.

71. The method of claim 70, further comprising conducting electricity through each of the inner and outer tubular elements, thereby supplying electrical power to at least one of the first and second piston assemblies.

72. The method of claim 51, further comprising a second set of the first and second piston assemblies, the first and second sets being incorporated in the same tubular string.

73. The method of claim 51, wherein the first piston assembly includes a first valve which selectively permits and prevents fluid communication between the first annulus and the second annulus, and wherein the second piston assembly includes a second valve which selectively permits and prevents fluid communication between the first annulus and a third annulus.

74. The method of claim 51, further comprising supplying electrical power from the first piston assembly to the second piston assembly.

75. The method of claim 51, wherein the first piston assembly includes a third gripping device which selectively grips the tubular string.

* * * * *